United States Patent [19]

Hasselschwert

[11] 4,132,524

[45] Jan. 2, 1979

[54] METHOD FOR WASHING RUGS AND THE LIKE

[75] Inventor: Clifford L. Hasselschwert, Rock Hill, S.C.

[73] Assignee: Indoor Billboard Corporation, Charlotte, N.C.

[21] Appl. No.: 863,511

[22] Filed: Dec. 22, 1977

Related U.S. Application Data

[62] Division of Ser. No. 742,672, Nov. 17, 1976, Pat. No. 4,095,443.

[51] Int. Cl.[2] ..... D06B 3/18; D06B 3/20

[52] U.S. Cl. ..... 8/151; 8/158

[58] Field of Search ..... 68/13 R, 22 R, 22 B, 68/39, 43, 44, 45, 46, 62, 99, 147, 175, 181 R, 205 R, 207, 208, 18 R; 15/40; 134/60, 9, 15; 210/522; 8/151, 158

[56] References Cited

U.S. PATENT DOCUMENTS

| | | | |
|---|---|---|---|
| 922,900 | 5/1909 | Hofmann | 68/43 X |
| 3,720,080 | 3/1973 | Grantham | 68/44 X |
| 3,762,869 | 10/1973 | Kennedy et al. | 68/205 R X |

FOREIGN PATENT DOCUMENTS

| | | | |
|---|---|---|---|
| 529588 | 9/1921 | France | 68/205 R |
| 911212 | 3/1946 | France | 134/60 |
| 2233808 | 1/1975 | France | 15/40 |
| 1218099 | 1/1971 | United Kingdom | 15/40 |

*Primary Examiner*—Philip R. Coe

*Attorney, Agent, or Firm*—Richards, Shefte & Pinckney

[57] ABSTRACT

Method and apparatus for washing rugs and the like which includes conveying a rug upwardly along an inclined path, with the nap of the rug facing upwardly, then compressing the rug, preferably by a roller, at a location extending transversely to the inclined path of the rug. A jet of water and detergent is then directed toward the rug as it is conveyed past the compressing roller to thereby form a pool of water and detergent that is dammed by the roller, such pool of water and detergent being continuously agitated by the directed jet to clean the rug. A cleaning brush may also be added ascensionally to the directed jet, and compartmentalized collection means may be provided for collecting the water and detergent mixture separately from the cleaner rinse water, with the rinse water being recirculated through the washing system to reduce the water requirements of the washing operation.

6 Claims, 5 Drawing Figures

METHOD FOR WASHING RUGS AND THE LIKE

CROSS-REFERENCES TO RELATED APPLICATIONS

This application is a division of parent application Ser. No. 742,672, filed Nov. 17, 1976, and now U.S. Pat. No. 4,095,443.

BACKGROUND OF THE INVENTION

In recent years, hard back entrance rugs or mats have become popular items for use at office locations of commercial and industrial enterprises, and these rugs are normally rented to such enterprises with the rental company being obligated to clean the rugs periodically. Such rugs are generally relatively small (e.g. 3 feet by 5 feet), and they include a backing of cotton-latex or nylon-vinyl to which are secured a variety of pilings, such as polyester, nylon, acrylic, and polypropylene.

The owner of such rugs is faced with the problem of cleaning large quantities of the rugs on a regular basis, and, as explained in greater detail in an article appearing at page 46 of the May, 1975, issue of *Industrial Launderer* magazine, two general types of cleaning equipment have been available heretofore for cleaning these rugs.

The first type are so-called "dry" machines which provide only mechanical means for vigorously beating the rugs, and which have been found to be unacceptable.

Additionally, "wet" machines are available which include, in various combinations, water and detergent sprays to soak the rug, and a plurality of brushes or mechanical fingers which are pressed against the rug piling to agitate the piling mechanically and loosen the dirt therefrom. While this type of cleaning equipment generally provides satisfactory cleaning results, the severe mechanical agitation of the piling by the brushes has a deleterious effect on the piling fibers, particularly in rugs having flocking secured to the rug backing by an adhesive in a predetermined design as disclosed, for example, in U.S. Pat. No. 3,793,050, issued Feb. 19, 1974, to Mumpower. Moreover, the adverse effects of mechanical agitation also serve to limit substantially the speed at which the rugs can be moved past the brushes, thereby limiting the cleaning cycle time for such rug cleaning equipment.

SUMMARY OF THE INVENTION

In accordance with the present invention, a method is provided for cleaning rugs or mats and the like in a continuous manner by conveying a rug upwardly along an inclined path with the nap or piling of the rug facing upwardly, compressing the rug nap at a location extending transversely to the inclined path of the rug, and directing a jet of water and detergent toward the nap of the rug as it is conveyed past the compressing location. The inclined path of the rug and the damming effect of the compression cause the water and detergent from the jet to form a pool adjacent the compressing member, and the jet is directed toward this pool to agitate continuously the nap of the rug and thereby loosen any dirt which may be present in such nap, whereupon the loosened dirt is carried away with the drainage of the water and detergent. Thus, the dirt loosening agitation required to clean the rug properly is supplied by the directed jet acting against the pooled water and detergent, rather than by the mechanical agitation of brushes and the like which can be harmful to the rug nap.

Preferably, the rug nap is preliminarily soaked with water and detergent, as by spraying, prior to the rug being conveyed to the compressing location whereby the detergent will begin to loosen the dirt to some extent before the rug is subjected to the agitation of the jet.

Additionally, an adjustable rotating brush may be provided along the inclined path of the rug to lightly engage the extending ends of the rug nap ascensionally of the jet agitation thereof whereby more thorough cleaning will be obtained in some instances. However, it is to be emphasized that the primary source of dirt loosening agitation is supplied by the jet directed at the pool of water and detergent, and the cleaning action of the brush is entirely secondary. Thus, only one brush is required, and it may be arranged so as to engage the rug nap lightly and thereby avoid the aforementioned drawbacks of prior art rug washing equipment that relies almost entirely on the mechanical agitation of brushes to clean the rug.

In accordance with a further feature of the present invention, an additional compressing roller may be employed ascensionally of the first compressing roller and the rotating brush to thereby cause the rug to be held between two rollers as it is being agitated by the jet and brushed, and a jet of rinse water may be directed against the rug nap as it is conveyed past the second compressing roller to form a pool of rinse water that is continuously agitated by the jet of rinse water in the same manner as that described above in conjunction with the jet of water and detergent.

Finally, the present invention provides a water saving feature that includes a collecting arrangement having separate compartments located beneath the rug at locations for collecting the rinse water, and the water and detergent mixture, respectively. The rinse water compartment may be sub-divided by weirs of constantly decreasing heights to distribute the dirt contained in the rinse water and to carry off floating debris in the rinse water, whereby the relatively clean rinse water can be recirculated through the washing system and reduce the overall quantity of fresh water used by the cleaning equipment.

DESCRIPTION OF THE PREFERRED EMBODIMENT

Figure 2:
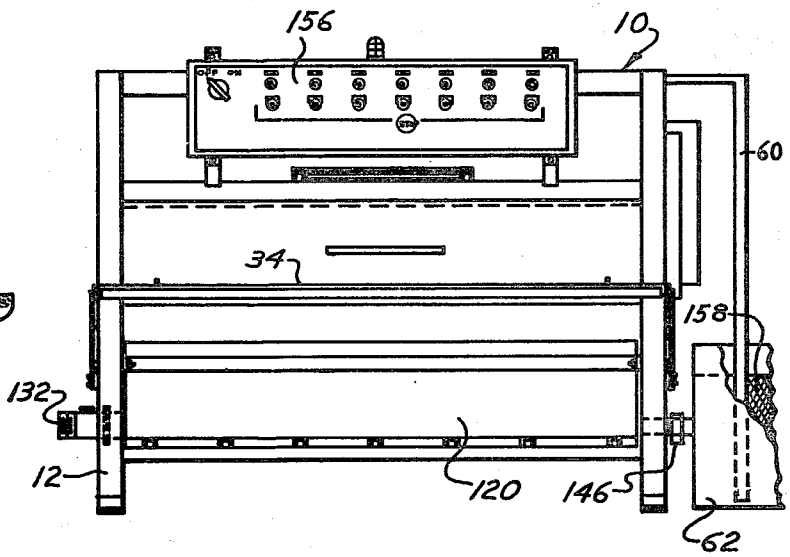
FIG. 2 is a front end view of the rug working machine illustrated in FIG. 1.
Figure 1:
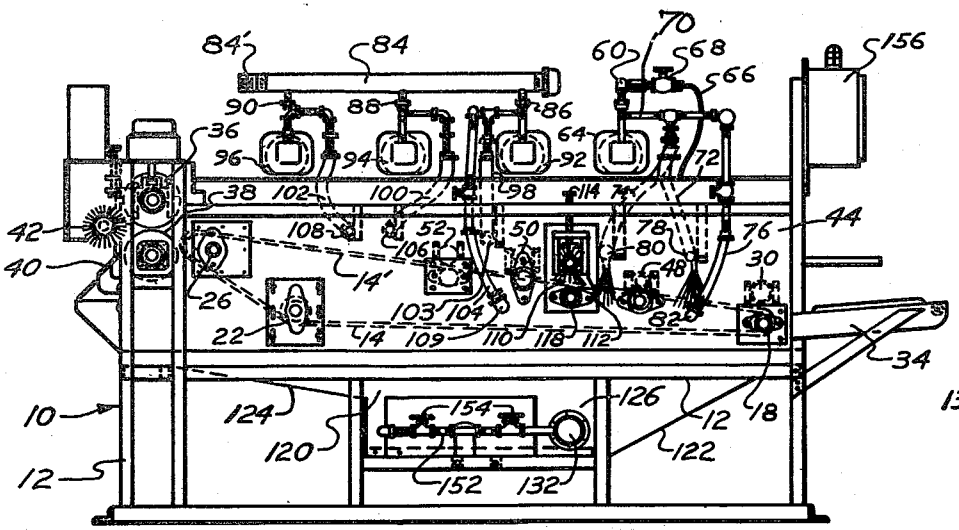
FIG. 1 is a left side elevation view of a rug washing machine embodying the present invention.
Figure 3:
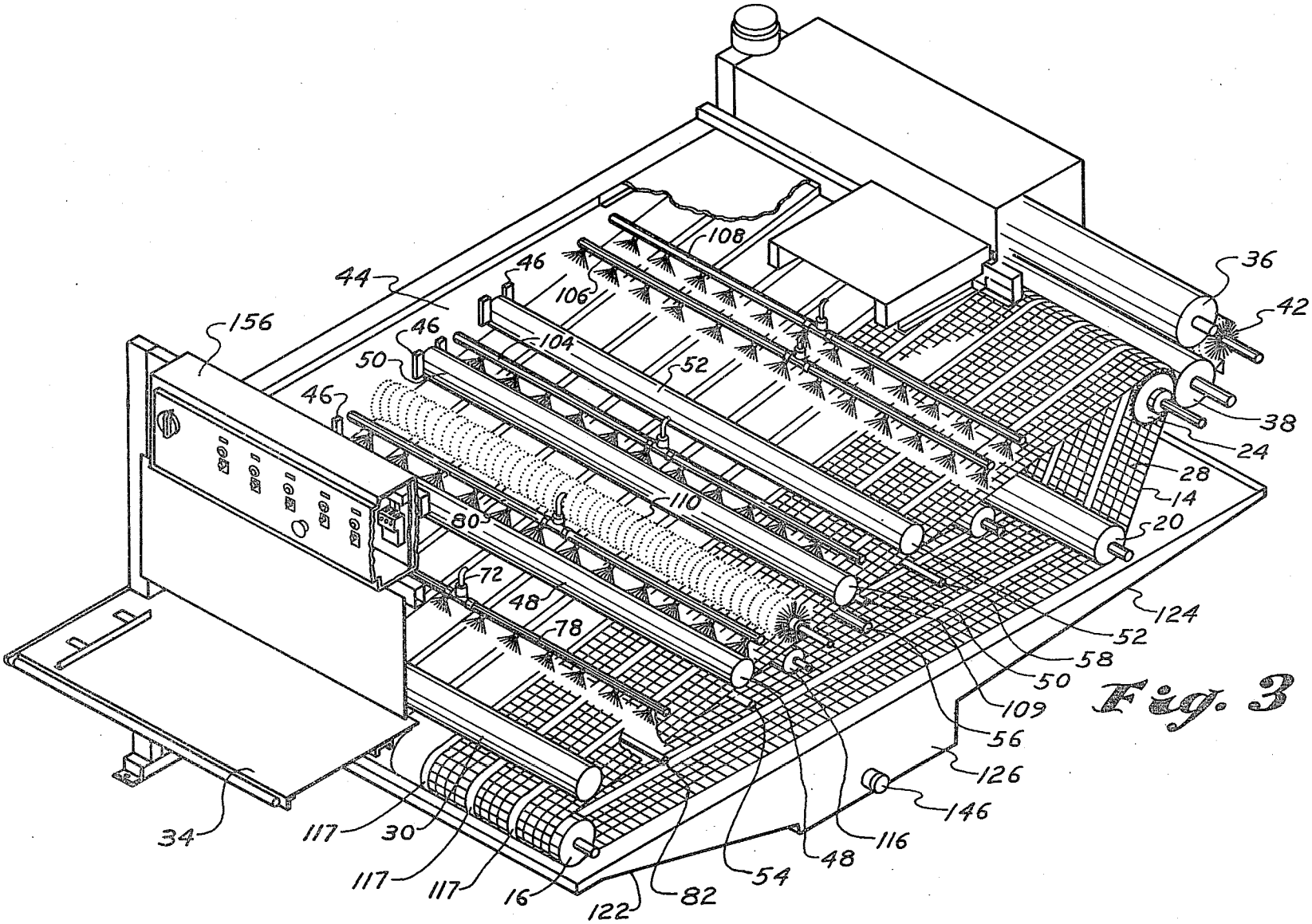
FIG. 3 is a perspective view illustrating the conveyor and washing components of the rug washing machine shown in FIG. 1.

Looking now in greater detail at the accompanying drawings, FIGS. 1–3 illustrate a rug washing machine 10, embodying the present invention, which includes a frame 12 on which an endless conveyor 14 is mounted about a turn roller 16 mounted in a bearing 18, a take-up roller 20 mounted in a bearing 22, and a drive roller 24 mounted in a bearing 26, the drive roller 24 being driven at a selectively variable speed through a conventional chain-and-sprocket arrangement (not shown) from a suitable electric motor (not shown). The conveyor 14 includes an inclined reach 14' extending upwardly from the turn roller 16 to the drive roller 24, and includes a plurality of spaced, open mesh chain belts 28 (see FIG. 3) with a first hold-down roller being mounted above the turn roller 16 at the inlet or front end of the rug washing machine 10. Also mounted to the frame 12 is a loading shelf 34 on which rugs are placed for feeding onto the conveyor 14, and a pair of squeezing rollers 36, 38 located at the discharge end of the conveyor 14 for squeezing the rugs after they have been cleaned and for directing the rugs to a stripper plate 40 that removes the cleaned rugs from the machine, the stripper plate 40 being disposed adjacent a rotating nap brush 42 which assist in raising the wet nap of the rug after it has been cleaned.

The frame 12 includes upstanding side walls 44 at opposite sides of the conveyor 14, and retainer blocks 46 are fixed to the side walls 44 for retaining three compression rollers 48, 50 and 52 spaced along the inclined reach 14' of the conveyor 14. The compression rollers 48, 50 and 52 are not driven, but they are free to rotate within the retainer blocks 46 and to slide vertically therein so that the weight of the compression rollers 48, 50 and 52 cause them to be biased against a rug carried by the conveyor reach 14'. Three support rollers 54, 56 and 58 are mounted in bearings 54', 56', and 58' for rotation beneath the conveyor reach 14' to support the same, and these support rollers are also located directly beneath the weighted compression rollers 48, 50 and 52 to act therewith in compressing a rug passing therebetween as will be explained in further detail presently.

The superstructure of the frame 12 supports a water inlet pipe 60 extending upwardly from a holding tank 62 (see FIG. 2), across the top of the machine 10, and into the inlet of a suitable motor operated pump 64. The inlet pipe 60 has connected thereto a detergent tube 66 leading upwardly from a source of detergent, such as a drum (not shown), with an adjustable regulating valve 68 being located adjacent such connection to control the amount of detergent that is drawn into the inlet pipe 60 by the suction of the pump 64. A discharge pipe 70 extends from the outlet of the pump 64 to a connection with hoses 72, 74, 76 connected, respectively, to two spray bars 78, 80 located above the conveyor reach 14' and one spray bar 82 located beneath the conveyor reach 14' as best seen in FIGS. 1 and 3. Each of the spray bars 78, 80 and 82 include a plurality of apertures spaced along the length thereof and designed to direct a concentrated jet of water and detergent toward the rug as it passes up the inclined conveyor reach 14', it being noted particularly that the jets from the spray bar 80 are directed toward the nap of the rug as it is conveyed past the compression roller 48 for a purpose to be explained in greater detail presently.

Similarly, the frame 12 supports a rinse water inlet manifold 84 having an end 84' that is connectable to any convenient source of fresh water (not shown), and this inlet manifold 84 is connected to three inlet pipes 86, 88 and 90, each leading to the intake side of a motor driven pump 92, 94 and 96, respectively. The discharge side of the pumps 92, 94 and 96 are connected to discharge conduits 98, 100, 102 and 103 leading to three rinse water spray bars 104, 106, 108 located above the inclined conveyor reach 14', and one rinse water spray bar 109 located beneath the inclined conveyor reach 14', it being noted that each of the spray bars 104, 106 and 108 include apertures, as described above, for directing a jet of rinse water toward the nap of the rug as it is conveyed upwardly along the inclined conveyor reach 14', and spray bar 109 similarly directs the jet of rinse water against the back of the rug.

In the preferred embodiment of the present invention, a cleaning brush 110 having helically arranged bristles is rotatably carried in a bracket 112 (see FIG. 1) that is mounted to the frame 12 by an adjustable bolt 114 which permits the brush to be selectively raised and lowered with respect to the inclined conveyor reach 14' and the rug carried thereby, the cleaning brush 110 being driven by any convenient source such as an electric motor (not shown) to rotate in a clockwise direction as seen in FIG. 1. A further support roller 116 may be mounted in bearings 118 for disposition beneath the inclined conveyor reach 14' and opposite to the cleaning brush 110.

The turn roller 16 is formed with a plurality of annular shoulders 117 located in the spacing between each chain belt 28 (see FIG. 3), and similar shoulders are formed on support rollers 54, 56, 58 and 116 to maintain the chain belts 28 in spaced relation and to guide them as they moved up the inclined conveyor reach 14'. Their shoulders have a height or thickness that is about the same as the thickness of the chain belts 28 so that the rugs being conveyed up the inclined conveyor reach 14 are supported on an uninterrupted flat surface at locations where the rugs are compressed by compression rollers 30, 48, 50, 58.

Figure 5:
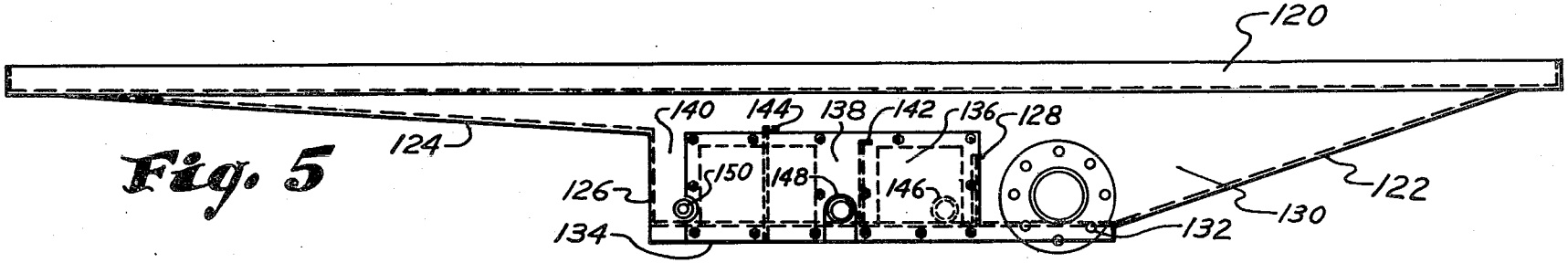
FIG. 5 is a side elevation view of the water collecting portion of the rug washing machine illustrated in FIG. 1.

The bottom of the frame 12 has mounted thereto a drain pan 120 that extends across the entire machine 10 beneath the conveyor 14. The drain pan 120 includes an inclined wall 122 located beneath the front or inlet end of the rug washing machine 10 and a second inclined wall 124 located beneath the back or outlet end of the machine 10, and a compartmentalized chamber 126 is located intermediate the inclined walls 122 and 124, as best seen in FIG. 5. The chamber 126 has a first baffle or weir 128 extending across the entire width of the drain pan 120, and located substantially directly beneath the intermediate compression roller 50. This baffle separates the chamber 126 into a waste water compartment 130 having a drain connection 132 leading therefrom at the left side of the machine 10 (see FIGS. 2 and 5), and a rinse water compartment 134. The rinse water compartment 134 is divided into three subcompartments 136, 138 and 140 by two additional upstanding baffles or weirs 142, 144 which extend across the entire width of the machine 10. It will be noted that the intermediate weir 142 has a greater height than the weir 128 and a lesser height than the weir 144, whereby the height of the weirs 142, 144 increase as their spacing from weir 128 increases. The subcompartment 136 includes an outlet pipe 146 extending therefrom at the right side of the machine 10 to a connection with the holding tank 62 (see FIG. 2), and the subcompartments 138 and 140 include outlet pipes 148 and 150, respectively, both of which are connected to an outlet manifold pipe 152 which is, in turn, connected to the waste water drain connection 132 (see FIG. 1) at the left side of the machine 10, the outlet manifold pipe 152 having two valves 154 disposed therein for selectively opening either or both of the outlet pipes 148, 150 to the water drain connection 132.

The operation of the above-described rug washing machine 10 is as follows. Water is supplied to the rinse water inlet manifold 84, and the holding tank 62 is initially charged with a supply of water. Appropriate switches on the control panel 156 are operated to energize the motor drives for the conveyor 14, the nap brush 42, cleaning brush 110, squeeze rollers 36, 38, and the pumps 64, 92, 94 and 96. Two rugs of normal size (e.g. 3 feet by 5 feet) are placed side-by-side on the loading shelf 34 and fed to the conveyor 14 which supports the rugs with the nap thereof facing upwardly, and conveys them upwardly along the inclined path defined by the conveyor reach 14'. As the rugs are conveyed upwardly along this inclined path, they will first pass between the spray bars 78 and 82 which spray a mixture of water and detergent against the nap and the bottom surface of the rugs whereby the backing of the rugs is cleaned and the nap is saturated with water and detergent so that the detergent begins to loosen the dirt in the nap.

Figure 4:
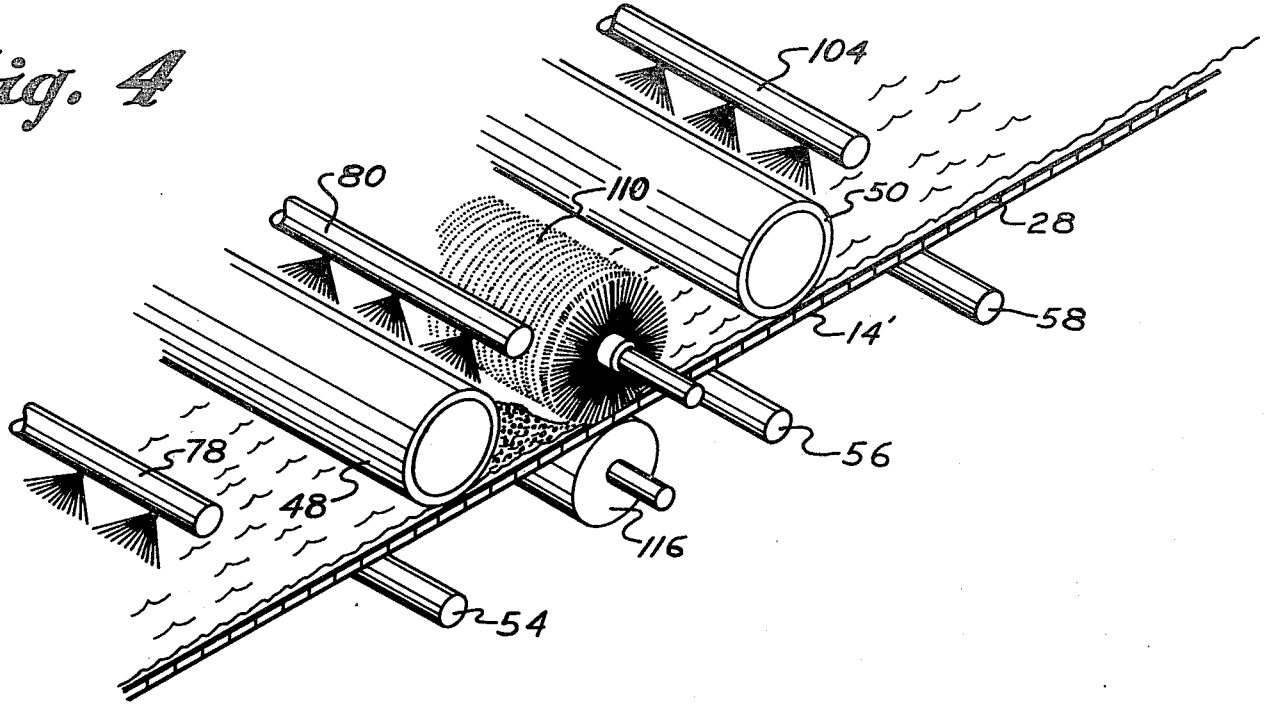
FIG. 4 is a detail view showing a particular washing portion of the rug washing machine illustrated in FIG. 1.

The rugs then continue up the inclined path of conveyor reach 14' until they reach the first compression roller 48 which, as described above, compresses the nap of the rugs as they pass beneath the compression rollers 48, as best seen in FIG. 4. The spray bar 80 directs a concentrated jet of water and detergent toward the nap of the rugs as they are conveyed past the compression roller 48. Since the compression roller 48 extends transversely across the rugs and bears downwardly thereagainst, and since the rugs are moving upwardly along an inclined path, the compression roller 48 forms a dam for the water and detergent being discharged to collect as a pool at the upstream or ascensional side of the compression roller 80. This pool of water and detergent is continuously agitated by the jet of water and detergent directed thereagainst, and this agitation combined with the cleaning action of the detergent results in a vigorous working of the rugs naps that loosens the dirt in such naps and causes the dirt to become entrained in the water and detergent mixture.

The aforementioned jet agitation and working of the rug nap provides excellent cleaning results. These results are improved still further by selectively adjusting the position of the cleaning brush 110, which is mounted ascentionally of the compression roller 48 and the spray bar 80, so that it makes only slight contact with the extending ends of the naps of the conveyed rugs so as to provide a light mechanical agitation for assisting the jet agitation. However, because of the generally thorough cleaning results which are obtained from the jet agitation alone, the mechanical agitation of the cleaning brush 110, is substantially less severe than the mechanical agitation required when brushing is used as the sole means of agitation, and, as a consequence, the nap of the rugs cleaned by the machine of the present invention is not burdened with the aforementioned drawbacks found in prior art mechanical brush cleaning machines.

As the rugs are conveyed upwardly beyond the cleaning brush 110, they will be compressed again by the second compression roller 50 which acts to compress or squeeze the nap of the rugs in the same manner as compression roller 48, described above. Thus, the rugs are generally held at two spaced transverse locations by the compression rollers 48 and 50, with the spray bar 80 and the cleaning brush 110 located therebetween, whereby the rugs and held in a somewhat taut disposition which renders the cleaning action of the spray bar 80 and the cleaning brush 110 more effective.

Additionally, the rinse water spray bar 104 is located ascentionally of the compression roller 50 for directing rinse water toward the rug naps as they are conveyed past the compression rollers 50, whereby the rinse water will collect at the dam formed by the compression roller 50 and be agitated continuously by the jet of rinse water in the same manner as that described above. This jet agitation acts to assist in rinsing the rugs naps so that the remaining dirt and detergent are carried away with the rinse water.

The rugs are then conveyed past another compression roller 52 which tends to squeeze out the rinse water and the dirt and detergent entrained therein, and the rugs are then subjected to additional rinsing by the jet sprays from spray bar 106 and 108. The rugs are then squeezed again by the heavier squeeze rollers 36, 38 to remove most of the water therefrom, and the rugs then move past the nap brush 42 which acts to raise the nap of the rugs and thereby permit better circulation of air around the rug piling during drying, while also removing any lint particles which remain on the surface of the rugs.

Thus, the rug washing machine 10 provides a thorough cleaning operation which utilizes a plurality of sequential cleaning steps, including a pre-soaking by spray bar 78, first light extraction by the squeezing of compression roller 48, jet agitation washing by spray bar 80, second light extraction by the compression roller 50, jet agitation rinsing by spray bar 104, third light extraction by the compression roller 52, second and third spray rinsing by spray bars 106 and 108, final extraction by the squeeze rollers 36, 38, and pile lifting and cleaning by the nap brush 42.

The present invention also provides a novel manner of collecting the rinse water separately from the mixture of water and detergent, and then recirculating this collected rinse water through the cleaning operation to reduce the quantity of fresh water needed to operate the machine 10. As best seen in FIGS. 3 and 5, the drain pan 120 is located directly beneath the conveyor 14 and extends beyond the conveyor 14 at all sides thereof so that all of the rinse water, and the water and detergent mixture, sprayed from spray bars 78, 80, 104, 106 and 108 eventually flow downwardly into the drain pan 120, either through the open mesh of the conveyor 14 or over the sides thereof. Since the dividing baffle or weir 128 is positioned substantially directly beneath the intermediate compression roller 50, as described above, it will be apparent that substantially all of the dirty mixture of water and detergent discharged from the spray bars 78 and 80 will tend to fall into the drain pan 120 at locations to the right of baffle 128 for collection in the waste water compartment 130. On the other hand, all of the rinse water discharged from the rinse water spray bars 104, 106 and 108 will tend to fall into the drain pan at locations to the left of baffle 128 for collection in the rinse water compartment 134. Because of the high concentration of dirt and used detergent which is included with the water in the waste water compartment 130, this water cannot be efficiently reused and it is therefore permitted to be discharged to a sewer connection or the like through the drain connection 132. However, the rinse water collected in the rinse water comparment 134 is mixed with only a relatively small amount of detergent, and it can be reused effectively if most of the dirt is removed therefrom.

The rinse water compartment 134 is preferably subdivided in a plurality of subcompartments by the baffles or weirs 142 and 144. Most of the rinse water falling into the drain pan 120 will hit the inclined wall 124 and flow toward the subcompartment 140, and the hearvier dirt and foreign matter entrained in such rinse water will settle to the bottom of the subcompartment 140. When the level of the rinse water in subcompartment 140 exceeds the height of the weir 144, the rinse water will flow over the weir 144 and into subcompartment 138 where additionally dirt is permitted to settle to the bottom. Similarly, when the rinse water level in the subcompartment 138 exceeds the height of weir 142, it will flow into subcompartment 136 where still more dirt settles. Finally, if the water level in subcompartment 136 exceeds the height of weir 128, it will flow to the waste water compartment 130 and out through the drain connection 132.

The water which is finally collected in the subcompartment 136 is permitted to flow through the outlet 146 to the holding tank 62 (see FIG. 2) which has one or more filters 158 disposed therein between the outlet 146 connection and the water inlet pipe 60 leading to the water and detergent pump 64 so that the rinse water must pass through the filters 158 before it reaches the water inlet pipe 60. Thus, the rinse water is collected by the drain pan 120 and kept generally separate from the water and detergent mixture, then is caused to flow through a plurality of subcompartments in which dirt settles to the bottom, and finally passed through filters 158 before it is recirculated through the water and detergent spray bars 78, 80 and 82. As a result, the recirculated water is relatively clean and is entirely suitable for use in mixing with detergent for subsequent cleaning action.

By dividing the rinse water compartment 134 into a plurality of subcompartments, most of the large volume of dirt entrained in the rinse water is collected in the first two subcompartments 138 and 140 so that very little dirt is present in the last subcompartment 136 or in the rinse water discharged through outlet 146. Additionally, because of the weir action of the baffles 128, 142 and 144, all of the lighter foreign matter, such as lint and some residual detergent, will float on top of the water in the subcompartments and eventually flow over the smallest baffle 128 into the waste water compartment rather than being discharged through outlet 146 for recirculation. Accordingly, the rinse water which is ultimately recirculated through the water and detergent spray bars is relatively clean. The outlets 148 and 150 from the subcompartments 138 and 140, respectively, and the manifold 152 permit the subcompartments 138 and 140 to be easily cleaned at periodic intervals by simply flushing a stream of water through such subcompartments to carry the dirt through the manifold 152 and the open valves 154 to the waste water drain connection 132.

In a typical rug washing operation of the machine 10, the conveyor 14 is operated at a speed of about 17–20 feet per minute so that the machine 10 can wash approximately 350 rugs of a 3′ × 5′ size per hour. This conveyor speed, and the resulting rug washing capacity, is substantially greater than the speed of existing rug washing machines which rely solely upon mechanical agitation of the rug, and which therefore have a limited maximum linear speed of about twelve feet per minute.

Additionally, the unique rinse water recirculation feature of the present invention results in a considerable reduction in water consumption. Without this feature, this rug washing machine 10 would use approximately one hundred gallons of water per minute, but this consumption is reduced to about sixty gallons per minute by the rinse water recirculation feature. When the rug washing machine 10 is operated for many hours during each day, as would be typical in a normal commercial use, it will be appreciated that this feature will result in substantial savings in water costs to the user.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A method of washing rugs and the like comprising the steps of:

(a) supporting a rug with the nap thereof facing upwardly;

(b) conveying said rug upwardly along an inclined path;

(c) compressing the nap of said rug at a location extending transversely to said inclined path;

(d) directing a jet of water and detergent toward the nap of said rug as it is conveyed past said compressing location to thereby form a pool of water and detergent immediately ascensional of said compression location which pool is continuously agitated by said directed jet to cause cleaning of said rug.

2. A method of washing said rugs and the like as defined in claim 1 and further characterized by the step of preliminarily saturating said rug with water and detergent at a location descensional to said compressing location.

3. A method of washing rugs and the like as defined in claim 1 and further characterized by the steps of providing a rotating brush at a location immediately ascensional to said directed jet and extending transversely to said inclined path, and selectively adjusting the position of said brush to engage only the extending ends of said rug nap.

4. A method of washing rugs and the like as defined in claim 3 and further characterized by the steps of additionally compressing the nap of said rug at a second location ascensional to said brushing location and extending transversely to said inclined path, and directing a jet of rinse water toward the nap of said rug as it is conveyed past said second compressing location.

5. A method of washing rugs and the like as defined in claim 4 and further characterized by the steps of providing separate compartments arranged beneath said inclined path at locations for collecting said rinse water and said water and detergent, respectively, and recirculating said collected rinse water to said directed jet of water and detergent.

6. A method of washing rugs and the like as defined in claim 5 and further characterized by the steps of dividing said rinse water compartment from said water and detergent compartment with a first weir of predetermined height, subdividing said rinse water compartment into a plurality of subcompartments with additional weirs, increasing the height of each said additional weir as its spacing from said first weir increased, and recirculating said collected rinse water only from said subcompartment defined by said first weir and the next adjacent additional weir.

* * * * *